US010471490B2

(12) United States Patent
Sireude et al.

(10) Patent No.: US 10,471,490 B2
(45) Date of Patent: Nov. 12, 2019

(54) MACHINE AND METHOD OF BENDING A LONGITUDINAL CYLINDRICAL PIPE

(71) Applicant: STELIA AEROSPACE, Rochefort (FR)

(72) Inventors: Damien Sireude, Nantes (FR); Daniel Perherin, Pont Aven (FR)

(73) Assignee: Stelia Aerospace, Rochefort (FR)

( * ) Notice: Subject to any disclaimer, the term of this patent is extended or adjusted under 35 U.S.C. 154(b) by 36 days.

(21) Appl. No.: 15/454,896

(22) Filed: Mar. 9, 2017

(65) Prior Publication Data

US 2017/0259318 A1 Sep. 14, 2017

(30) Foreign Application Priority Data

Mar. 11, 2016 (FR) ..... 16 52051

(51) Int. Cl.
*B21D 7/00* (2006.01)
*B21D 7/16* (2006.01)

(52) U.S. Cl.
CPC ..... *B21D 7/162* (2013.01)

(58) Field of Classification Search
CPC ..... B21D 7/12; B21D 7/162; B21D 7/025
See application file for complete search history.

(56) References Cited

U.S. PATENT DOCUMENTS 5,422,048 A * 6/1995 Kodama ..... B29C 35/0261 264/173.17
2010/0218577 A1* 9/2010 Tomizawa ..... B21D 7/08 72/128
2010/0257909 A1* 10/2010 Huskamp ..... B21D 22/02 72/21.1
2012/0079866 A1* 4/2012 Kuwayama ..... B21D 7/12 72/342.6
2012/0325806 A1* 12/2012 Okada ..... C21D 1/42 219/672

FOREIGN PATENT DOCUMENTS

| | | | | |
|---|---|---|---|---|
| DE | 2329113 A1 * | 1/1975 | ..... | B21D 7/162 |
| DE | 4039567 A1 | 8/1991 | | |
| DE | 102004002539 A1 | 8/2005 | | |
| EP | 0045470 A1 | 2/1982 | | |
| EP | 2433723 A1 | 3/2012 | | |
| GB | 2146558 A | 4/1985 | | |

OTHER PUBLICATIONS

Search Report from FR Intellectual Property Office on co-pending FR application (FR1652051) dated Dec. 6, 2016.

* cited by examiner

*Primary Examiner* — Debra M Sullivan
(74) *Attorney, Agent, or Firm* — Klein, O'Neill & Singh, LLP

(57) ABSTRACT

Machine for bending at least one longitudinal cylindrical pipe, the bending machine having at least one heating module configured so as to heat a longitudinal cylindrical pipe and at least one deformation module configured so as to deform a longitudinal portion of a longitudinal cylindrical pipe in order to bend it, said heating module having a plurality of heating units, each heating unit can include a peripheral heating body defining an internal opening adapted to allow the passage of a longitudinal portion of a longitudinal cylindrical pipe to be heated.

23 Claims, 3 Drawing Sheets

MACHINE AND METHOD OF BENDING A LONGITUDINAL CYLINDRICAL PIPE

TECHNICAL FIELD

This invention concerns the field of bending a longitudinal cylindrical pipe, in particular, for an aeronautical application. Such a pipe allows any type of fluid to be conveyed, in particular, air, water or fuel.

In a known way, a bent pipe is obtained by bending a straight pipe by means of a bending machine. A bending machine usually comprises a mechanical deformation module that allows a portion of the pipe to be deformed mechanically. The deformation module comprises a mover unit and an abutment unit, the mover unit being configured to grip a longitudinal portion of the pipe in order to force it against the abutment unit. Thus the longitudinal portion of the pipe in contact with the abutment unit deforms and assumes the shape of the abutment unit. The deformation module is advantageously parametrable in order to adjust, for example, the length of the bent portion or the bending angle.

A known method of facilitating the deformation of the pipe involves equipping a bending machine with a heating module to heat the pipe prior to its deformation. In fact, heating a pipe, in particular one made of plastic, allows it to be softened and thus facilitates its deformation while limiting the risk of damage.

A heating module is known in the prior art that comprises two jaws, of complementary shapes, which are adapted, on the one hand, to grip between them a longitudinal portion of the pipe and, on the other, to heat it by thermal conduction. Each jaw is heated so that the heat of the jaw is transmitted by thermal conduction to the longitudinal portion of the pipe that is gripped. Such a heating module only allows one length of the longitudinal portion of the pipe to be heated, namely, that portion equal to the length of each jaw. Also, in practice, longitudinal portions of the pipe that are not to be deformed may be heated, which represents a waste of energy and can also weaken the pipe. Lastly, such jaws only allow pipes of the same diameter to be heated, which makes it necessary to change jaws to accommodate pipes of different diameters. Thus the use of jaws results in drawbacks on the logistical level and slows down bending operations (slow heating, long changeover, etc.).

SUMMARY

The invention concerns a machine for bending at least one longitudinal cylindrical pipe, the bending machine comprising at least one heating module configured so as to heat a longitudinal cylindrical pipe and at least one deformation module configured so as to deform a longitudinal portion of a longitudinal cylindrical pipe in order to bend it.

The invention is remarkable in that the said heating module comprises a plurality of heating units, each heating unit comprising a peripheral heating body defining an internal opening adapted to allow the passage of a longitudinal portion of a longitudinal cylindrical pipe to be heated.

Such a heating module allows a pipe to be heated peripherally and evenly, which limits the risk of damage during bending. Furthermore, such a heating module allows heating without contact, which prevents any mechanical damage to the pipe during heating. Advantageously, such a heating module allows pipes of different diameters to be heated. Further advantageously, the use of a plurality of heating units in the same heating module allows the heating length to be adjusted and avoids heating a part of the pipe that is not to be bent. The risk of damage can therefore be limited.

The internal openings of the heating units can be aligned along one axis. Thus the heating units can heat consecutive elementary portions of the longitudinal pipe when the latter extends along said axis. In other examples, the openings can be staggered or offset to assist with forming complex bends.

Two consecutive heating units can be spaced between 5 mm and 50 mm apart along the axis, preferably between 15 mm and 30 mm. This spacing can be selected as a compromise between continuous heating between two consecutive elementary portions of the pipe and limitation of the risk of excessive heating of an elementary portion of the pipe due to the accumulation of heat generated by said heating units.

In an example, the heating peripheral body extends in one plane so as to limit its size while allowing a shorter portion of pipe to be heated. The heating peripheral body can be between 5 mm and 20 mm thick with other thicknesses contemplated. In some examples, the heating peripheral body extends in a plane orthogonal to the axis along which the internal openings of the heating units are aligned so as to perform heating orthogonal to the pipe.

The heating peripheral body can be substantially annular so as to heat the periphery of the pipe evenly. The heating peripheral body can be omega-shaped, which allows its supply connector to be positioned radially outwards of the inner space. The size of the heating units in the heating module is thus limited. Each heating peripheral body can have an internal diameter of between 80 mm and 90 mm with other dimensions contemplated. For example, the size can be larger than 90 mm or smaller than 80 mm depending on the desired application.

The heating unit can be configured so as to concentrate the heat in its internal opening. Thus, the heating unit can be directional for optimal heating. The heating peripheral body can include a coating so as to direct said heating. The coating can be selected from a number of conductive materials, including gold.

The heating unit can emit infrared radiation. Said radiation allows a longitudinal portion to be heated quickly and efficiently.

The heating module can comprise a peripheral support casing in which the heating units are mounted. The efficiency of the heating units can be enhanced by the casing, which allows the heat to be reflected. The casing can be made of a metal material, such as aluminum or the internal surface of the casing can be covered with aluminum, preferably glazed, polished aluminum.

In an example, each heating unit comprises a plurality of heating peripheral bodies, preferably juxtaposed.

The bending machine can include a control module configured to activate a selection of said heating units of the heating module, including all of said heating units. Thus, the length of the longitudinal portion to be heated can be parameterized so as to avoid heating a part that is not to be bent.

The control module can be configured so as to parameterize the heating module in accordance with the parameterization of the deformation module. In other words, heating can be customized to suit the desired extent of bending. Thus, only the longitudinal portion of the object to be deformed can be targeted for heating, which limits the risk of damage.

The invention also concerns a method of bending at least one longitudinal cylindrical pipe utilizing a bending machine, such as the ones described elsewhere herein. In an example, the method can comprise:

a step of inserting a longitudinal portion of the longitudinal cylindrical pipe into the internal openings of the heating units of the heating module;

a step of heating at least part of the longitudinal portion heated by activating at least some of the heating units, and a step of deformation by the deformation module of a part of the longitudinal portion of the longitudinal cylindrical pipe so as to bend it.

A longitudinal portion of a pipe can be heated without contact with the heating module. Moreover, the heating length can be adjusted.

The method can include a step of determining a target longitudinal portion of the longitudinal cylindrical pipe to be bent, a step of heating the target longitudinal portion by the selective activation of the heating units and a step of deformation by the deformation module of said target portion.

Such a method allows customized heating to suit the desired extent of bending, among others. Advantageously, the risk of damage is limited, as is the risk of excessive heating.

BRIEF DESCRIPTION OF THE DRAWINGS

A better understanding of the invention will emerge from the following description, given solely by way of example, with reference to the accompanying drawings, in which.

Note that the Figures show the invention in detail to allow the invention to be implemented, said Figures clearly being capable of better defining the invention if necessary.

DETAILED DESCRIPTION

Figure 1:
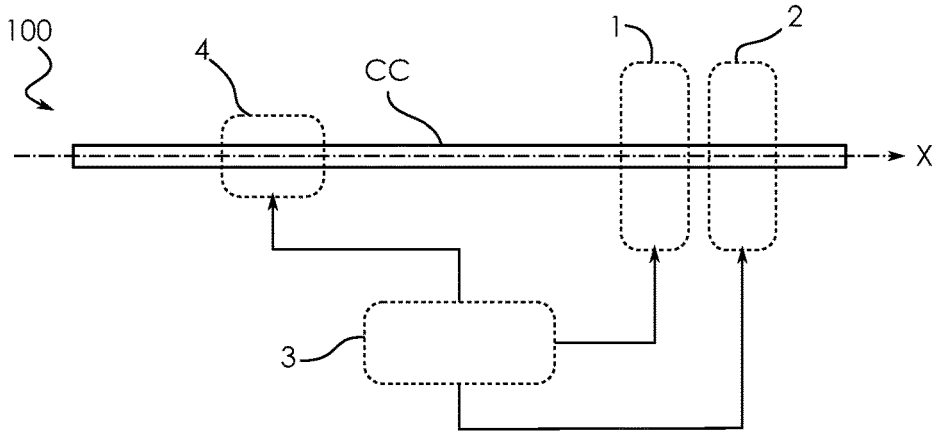
FIG. 1 is an overall schematic representation of a bending machine according to an embodiment of the invention.

FIG. 1 shows a machine 100 for bending at least one longitudinal cylindrical pipe CC. Said pipe CC can convey any type of fluid, in particular, air, water or fuel. A method of bending a pipe CC made of a thermoplastics material will be described below but it goes without saying that the invention applies also to a pipe made of a metallic material.

The bending machine 100 comprises several modules to allow the automated bending of a pipe CC. In particular, the bending machine 100 allows several bent longitudinal portions to be made, consecutively, in one and the same pipe CC.

As shown schematically in FIG. 1, the bending machine 100 comprises a heating module 1, a deformation module 2, a control module 3 and a transportation module 4 designed to move the pipe CC from the heating module 1 to the deformation module 2.

The deformation module 2 allows a longitudinal portion of the pipe CC to be bent as desired by the operator. In other words, the deformation module 2 is parametrable so as to create bent portions of different lengths and shapes (bending angle, bending direction, etc.).

Figure 2:
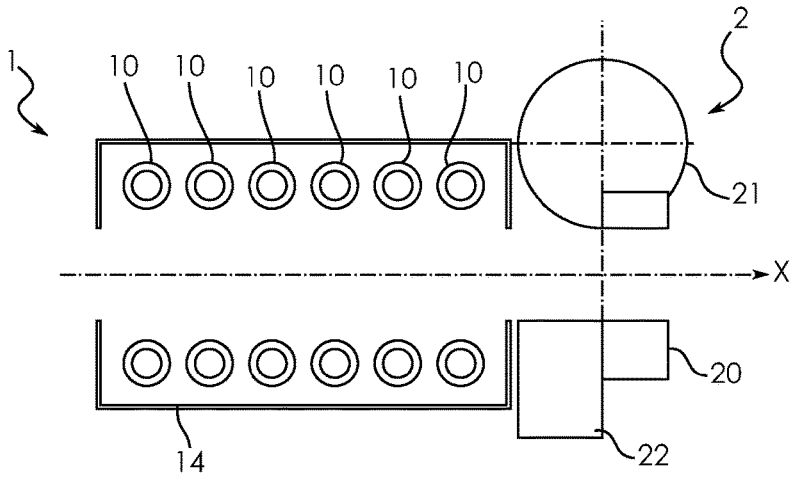
FIG. 2 is a schematic representation of a heating module and a deformation module according to an embodiment of the invention.

In this example, with reference to FIG. 2, the deformation module 2 comprises a mover unit 20, an abutment unit 21 and a pressure unit 22, the mover unit 20 being configured to force a portion of the pipe CC against the abutment unit 21, also called the "anvil", in order to bend it. Such a deformation module 2 is known to a person skilled in the art so will not be described in further detail.

As shown in FIG. 2, the bending machine 100 comprises a heating module 1 to heat the pipe CC before the latter is bent by the deformation module 2. Preliminary heating facilitates the mechanical deformation of the pipe CC. With reference to FIG. 1, the pipe CC is adapted to move upstream and downstream along an axis X in the bending machine 100. To this end the heating module 1 is located upstream of the deformation module 2.

With reference to FIGS. 1 and 2, the heating module 1 is located near the deformation module 2 so as to prevent cooling of the pipe CC when it moves along the axis X between the heating module 1 and the deformation module 2. Preferably, the axial distance between the heating module 1 and the deformation module 2 is less than 20 mm. Most preferably, the heating module 1 is separate from the deformation module 2 in order to offer greater freedom of movement to the deformation module 2 during the bending steps.

With reference to FIG. 2, the heating module 1 comprises a plurality of heating units 10. In this embodiment and by way of example, the heating module 1 comprises 6 heating units 10 mounted in a peripheral support casing 14 which will be described below.

Figure 3:
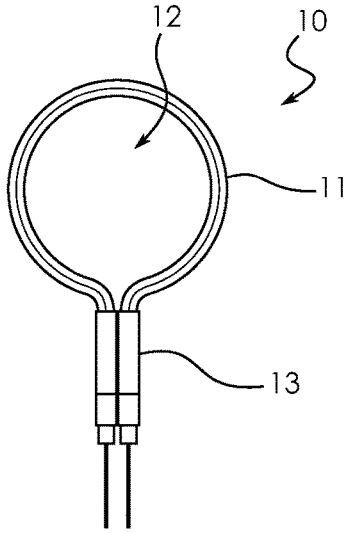
FIG. 3 is a front schematic representation of a heating unit of a heating module.

As shown in FIG. 3 representing a front view of a heating unit 10, each heating unit 10 comprises one heating peripheral body 11 defining an internal opening 12 adapted to allow the passage of a longitudinal portion of a pipe CC to be heated. Nevertheless, it goes without saying that a heating unit 10 could comprise several heating peripheral bodies, in particular, juxtaposed.

In this example, each heating unit 10 emits infrared radiation so as to heat the pipe CC without contact. Most preferably, each heating unit 10 emits infrared radiation of the short wave type, for example 0.76 to 2 μm, for a power on the order of 900 W, which allows fast heating to be performed.

In this example, each heating unit 10 is configured to concentrate the heating in its internal opening 12. Such a heating unit 10 allows targeted heating of a longitudinal portion of the pipe CC. To this end the heating peripheral body 11 comprises a reflective coating, for example gold, in order to direct the infrared radiation towards its internal opening 12. Most preferably, the coating is arranged on the radially outer part of the heating peripheral body 11. Most preferably, the heating peripheral body 11 extends in one plane in order to limit its size.

Preferably, the thickness of the heating peripheral body 11 is between 5 mm and 20 mm. More preferably, the heating peripheral body 11 is substantially annular, in particular, omega-shaped. In this example, the heating peripheral body 11 has a diameter of between 80 mm and 90 mm and allows a pipe CC with a diameter of between 9.52 mm and 50.8 mm to be heated. Such a heating peripheral body 11 allows uniform heating to be achieved at the periphery of the portion of the pipe CC to be heated. As shown in FIG. 3, the heating unit 10 comprises a connector 13 extending radially outwards from the heating peripheral body 11.

With reference to FIG. 2, the heating units 10 are positioned parallel to one another so that the internal openings 12 of the heating units 10 are aligned along an axis, in particular, the axis X of movement of the pipe CC in the bending machine 100 in order to concentrate the radiation on the pipe CC. Most preferably, each heating peripheral body 11 extends in a plane orthogonal to the axis X along which the internal openings 12 of the heating units 10 are aligned.

Most preferably, two consecutive heating units 10 are spaced apart by an axial distance of between 15 mm and 30 mm so as to achieve discreet heating of a plurality of consecutive elementary portions of a pipe CC. This spacing allows two consecutive elementary portions of a pipe CC to be heated continuously when the two consecutive heating units 10 are activated.

In this example, the heating units 10 are identical for the sake of simplicity but it goes without saying that they could be different.

Figure 4:
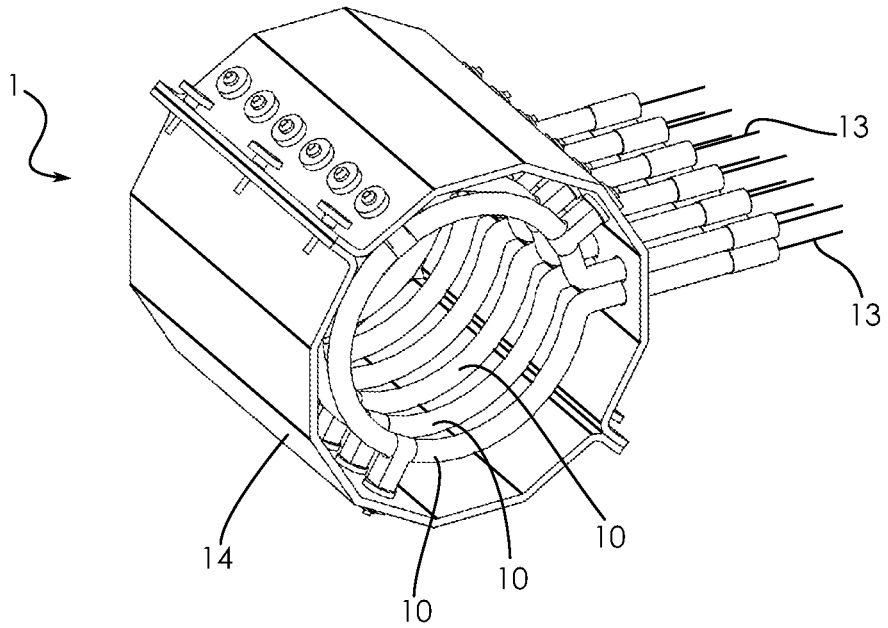
FIGS. 4 and 5 are perspective views of an embodiment of a heating module according to the invention.

As shown in particular in FIG. 4, the heating module 1 also comprises a peripheral support casing 14 extending axially, which comprises an inner face on which are supported the heating units 10. In other words, the heating units 10 are mounted inside the heating module 1.

Most preferably, the internal surface of the casing 14 is covered in aluminum, preferably, glazed polished aluminum, in order to concentrate and homogenize the radiation. Furthermore, it has a polygonal section, in this example, dodecagonal in order to confine the radiation. It goes without saying that a casing with a circular section could also be used. In this example, the inner surface of the support casing 14 is polished in order to reflect the infrared radiation towards the pipe CC and minimize the absorption of the radiation by the support casing 14.

Such a support casing 14 facilitates the positioning of the heating units 10 in relation to each other in a precise manner, for example, by means of positioning clamps allowing a heating unit 10 to be held (clamp closed) or to limit its travel (clamp open). In this example, each heating unit 10 is associated with one closed clamp and two open clamps. The support casing 14 is open at either axial end to allow a pipe CC to pass through along the axis X.

Preferably, the heating module 1 also comprises cooling means, in particular, a fan that is activated depending on the temperature measured inside the support casing 14.

Figure 5:
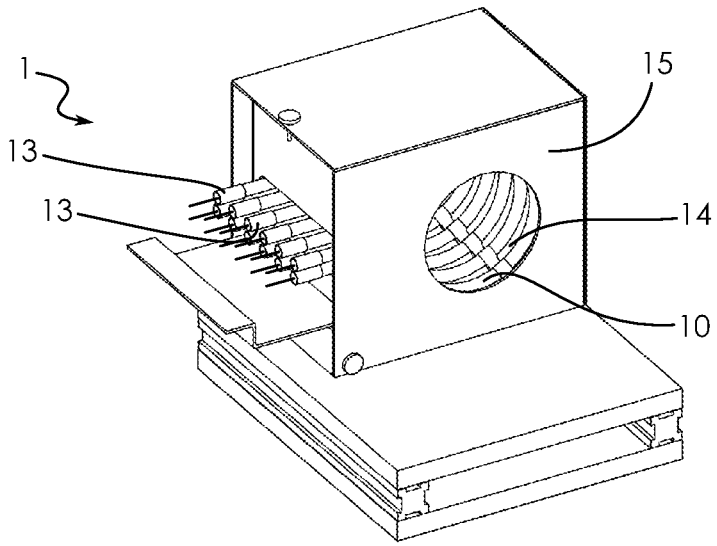

With reference to FIG. 5, the heating module 1 also comprises a peripheral protective housing 15, in which is mounted the support casing 14, in order to limit outward infrared radiation from the heating module 1.

In this example, with reference to FIG. 1, the transportation module 4 comprises an automated mover clamp (not shown) adapted to move the pipe along the displacement axis X. It goes without saying that the transportation module 4 could have a different form.

Preferably, the bending machine 100 comprises a temperature sensor (not shown), for example a pyrometer, to measure the temperature of the heated longitudinal portion of the pipe CC. The transportation module 4 is configured so as to move the pipe CC when a predetermined setpoint temperature is reached.

With reference to FIG. 1, the bending machine 100 also comprises a control module 3 configured to activate a selection of said heating units 10 of the heating module 1. Thus, advantageously, the heating module 1, does not generate heat along the entire length of the heating module 1 but only along a reduced length. Thus, only the portion of the pipe CC destined to be bent is heated, the portion that is not to be bent not being heated, which limits the risk of mechanical weakening due to heating.

Most preferably, the control module 3 is configured to activate the heating module 1 according to the parameterization of the deformation module 2. In other words, the control module 3 allows said modules 1, 2 to be coordinated so as to perform heating suited to the desired extent of bending, in particular, a predetermined bending angle. More preferably, the control module 3 also allows the transportation module 4 to be coordinated so as to heat, move and deform a target portion of the pipe CC automatically in order to improve efficiency.

Preferably, the control module 3 is in the form of a computer in which bending programs can be entered so as to form, in a quick and practical manner, a pipe of the desired shape from a longitudinal pipe.

A method of bending at least one longitudinal cylindrical pipe by means of the bending machine 100 will now be described with reference to FIGS. 6 to 9.

Advantageously, the longitudinal cylindrical pipe CC can have a diameter of between 9.52 mm and 50.8 mm, in particular, a diameter of 12.7, 19.05 or 25.4 mm.

Figure 6:
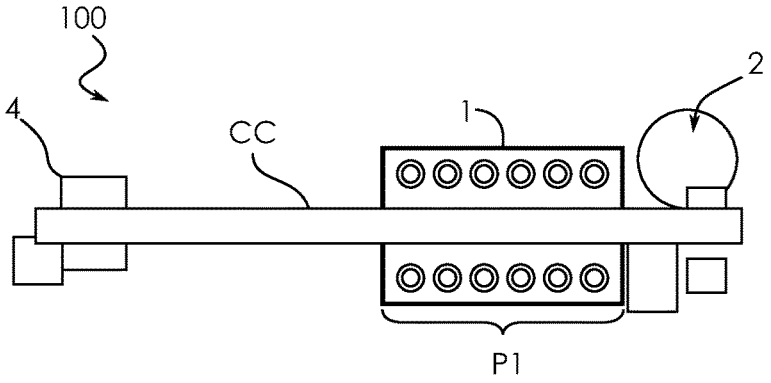
FIGS. 6 to 9 are schematic representations of a bending method according to the invention.

With reference to FIG. 6, a first longitudinal portion P1 of the longitudinal cylindrical pipe CC is inserted into the internal openings 12 of the heating units 10 of the heating module 1, in particular, along the displacement axis X. After insertion, the first longitudinal portion P1 extends to the center of the heating units 10 in their internal openings 12.

Figure 7:
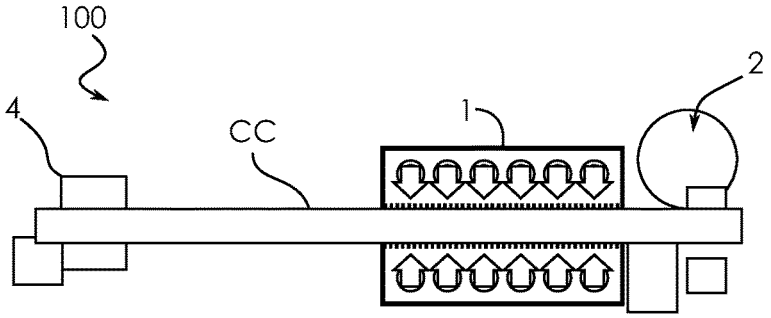

With reference to FIG. 7, the heating module 1 is then activated so as to heat the first longitudinal portion P1. In this example, the 6 heating units 10 are activated by the control module 3. Each heating unit 10 emits infrared radiation towards its center, in other words, towards the first longitudinal portion P1, which is thus heated without being in mechanical contact with said heating unit 10. An emission of infrared radiation allows rapid heating compared to heating by thermal conduction according to the prior art.

Then, the transportation module 4 moves the first longitudinal portion P1 into the deformation module 2. Preferably, a temperature sensor measures the temperature of the first longitudinal portion P1 and moves it when a setpoint temperature is reached.

In this example, the pipe CC is moved axially along displacement axis X. Advantageously, as the heating module 1 and the deformation module 2 are close to one another, the first longitudinal portion P1 is still at a high temperature during its deformation.

Figure 8:
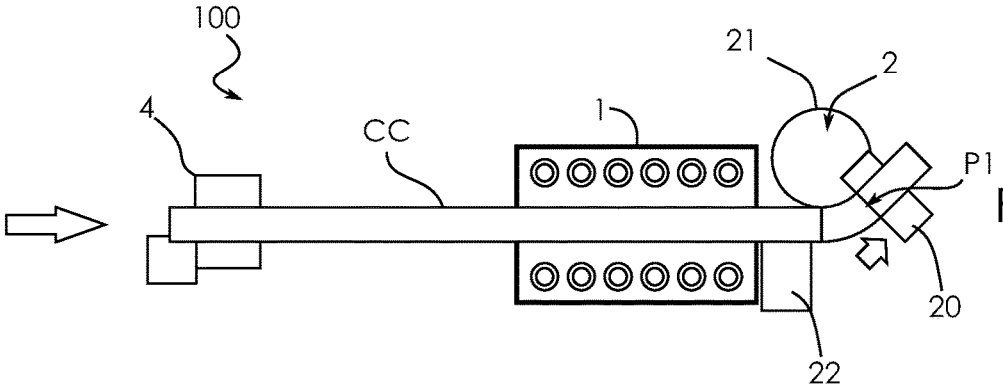

With reference to FIG. 8, the first longitudinal portion P1 located in the deformation module 2 is moved by the mover unit 20 against the abutment unit 21 in order to bend it. Since the first longitudinal portion P1 is at a high temperature, bending is achieved quickly and reliably, and the risk of damage is limited.

The control module 3 allows the different modules 1, 2, 4 to be coordinated so that the first longitudinal portion P1 is heated, moved and deformed quickly in order to achieve high efficiency.

After heating and deformation of the first longitudinal portion P1, a second longitudinal portion P2 of the pipe CC can also be heated and deformed. Advantageously, the second longitudinal portion P2 can be heated during the deformation of the first longitudinal portion P1.

Figure 9:
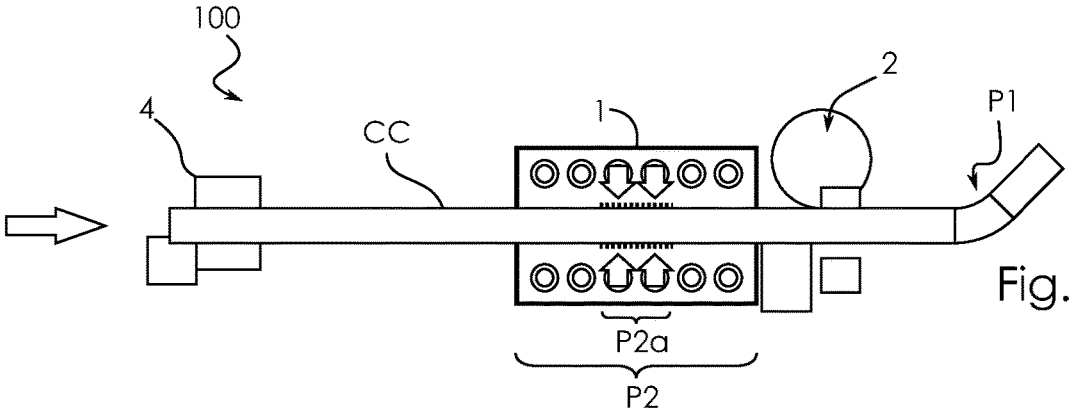

With reference to FIG. 9, a second longitudinal portion P2 is located in the heating module 1. Only some of the heating units 10 are activated by the control module 3 so as to heat only part P2*a* of the second longitudinal portion P2. In this example, only 2 heating units 10 are activated. Thanks to the invention, the length of the pipe CC to be heated can be precisely defined in order to avoid heating a part that does not need to be bent. The risk of failure when the material of the pipe is heated, in other words softened, is thus reduced.

Preferably, the control module 3 receives a bending program so as to form a pipe of the desired shape from a straight longitudinal pipe. The bending program comprises a list of longitudinal portions to be bent and the associated bending angle. To this end, the control module 3 determines the target longitudinal portion of the pipe CC to be bent and controls a heating of the said target longitudinal portion by the selective activation of the heating units 10 in accordance with the bending angle. The control module 3 orders the deformation of the said target portion in accordance with the parameterization defined in the bending program.

In other words, the control module 3 allows the operation of the bending machine 100 to be automated, coordinated and regulated in order to create the desired pipe. The pipe obtained is strong given that it is heated only to the extent necessary for it to be bent, without mechanical contact likely to damage it. Lastly, the energy efficiency for creating a bend is greatly improved.

What is claimed:

1. A bending machine for bending a longitudinal cylindrical pipe, the bending machine comprising:

a heating module configured to heat a longitudinal portion of the longitudinal cylindrical pipe comprising a thermoplastic material; and a deformation module configured to deform the longitudinal portion of the longitudinal cylindrical pipe in order to bend the longitudinal cylindrical pipe;

wherein the heating module comprises a plurality of heaters emitting heat in the form of infrared radiation, wherein each heater of the plurality of heaters comprises a peripheral heating body defining an internal opening adapted to allow passage of the longitudinal portion of the longitudinal cylindrical pipe to be heated, and wherein the heating module comprises a peripheral support casing extending axially which comprises an inner face supporting the plurality of heaters, and wherein two consecutive heaters of the plurality of heaters are spaced between 5 mm and 50 mm apart along a longitudinal axis of the peripheral support casing.

2. The bending machine according to claim 1, wherein the internal openings of the plurality of heaters are aligned along one axis, and wherein each heater of the plurality of heaters emits infrared radiation directed from at least two opposing sides of the peripheral heating body towards the internal opening of the heater.

3. The bending machine according to claim 2, wherein two consecutive heaters of the plurality of heaters are spaced between 15 mm and 30 mm apart along the axis.

4. The bending machine according to claim 1, wherein the peripheral heating body extends in one plane.

5. The bending machine according to claim 1, wherein the peripheral heating body is substantially annular.

6. The bending machine according to claim 1, wherein each heater is configured to concentrate heat towards a center of the internal opening of the heater.

7. The bending machine according to claim 1, wherein the bending machine comprises a control module configured to activate a selection of said heaters up to all of said plurality of heaters of the heating module.

8. The bending machine according to claim 7, wherein the control module is configured to parameterize the heating module in accordance with the parameterization of the deformation module.

9. The bending machine according to claim 1, wherein each heater of the plurality of heaters emits infrared radiation uniformly towards the internal opening of the peripheral heating body.

10. A method of bending a longitudinal cylindrical pipe, the method comprising:

a step of inserting a longitudinal portion of the longitudinal cylindrical pipe into internal openings of a plurality of heaters of a heating module, wherein the plurality of heaters are supported on an inner face of a peripheral support casing that extends axially, and wherein the longitudinal portion comprises a thermoplastic material;

a step of heating at least part of the longitudinal portion to produce a heated part of the longitudinal portion by activating at least some of the heaters of the plurality of heaters to emit infrared radiation; and a step of deforming the heated part of the longitudinal portion of the longitudinal cylindrical pipe to bend the longitudinal cylindrical pipe.

11. The method of claim 10, further comprising moving the longitudinal cylindrical pipe to heat a second longitudinal portion of the longitudinal cylindrical pipe, and wherein different numbers of heaters of the heating module are used to heat the second longitudinal portion.

12. The method of claim 11, further comprising moving the longitudinal cylindrical pipe with a mover unit located downstream of the heating module.

13. The method of claim 12, wherein a control module instructs the mover unit to move the longitudinal cylindrical pipe.

14. The method according to claim 10, wherein the step of heating the at least part of the longitudinal portion comprises activating only a portion of the heaters of the plurality of heaters to avoid heating a portion of the longitudinal portion that does not need to be deformed.

15. The method according to claim 10, further comprising:

a step of advancing the longitudinal cylindrical pipe to move a second part of the longitudinal portion into internal openings of the plurality of heaters of the heating module;

a step of activating only a portion of the heaters of the plurality of heaters to heat the second part of the longitudinal portion without heating a third part of the longitudinal portion; and a step of deforming the second part of the longitudinal portion of the longitudinal cylindrical pipe.

16. A bending machine for bending a pipe comprising:

a heating module for heating the pipe comprising a plurality of heaters in a spaced relationship, wherein each heater of the plurality of heaters is configured to emit infrared radiation when activated, and wherein each heater of the plurality of heaters comprises a peripheral heating body defining an internal opening adapted to allow a portion of the pipe to be heated to pass therethrough;

a peripheral support casing having a wall, an exterior surface, and an interior surface defining an interior cavity having the plurality of heaters located therein in spaced relationship;

a deformation module located downstream of the heating module, wherein the deformation module is configured to deform a thermoplastic portion of the pipe after the thermoplastic portion of the pipe is heated by the heating module.

17. The bending machine of claim 16, further comprising a bending program loaded onto a control module that provides a list of portions of the longitudinal cylindrical pipe to be bent.

18. The bending machine of claim 16, further comprising a peripheral protective housing located around the peripheral support casing.

19. The bending machine of claim 16, wherein each of the plurality of heaters extend along a single plane.

20. The bending machine of claim 16, further comprising a transportation module located upstream of the heating module and a mover unit located downstream of the heating module; said mover unit configured to move heated section of a pipe against an anvil.

21. The bending machine of claim 20, further comprising a control module having a bending program loaded therewith, said control module providing instructions for moving a pipe to be heated and for selecting which of the plurality of heaters to be activated.

22. The bending machine of claim 16, wherein two or more consecutively positioned heaters are heated at any one time.

23. The bending machine according to claim 16, wherein an internal surface of the peripheral support casing comprises aluminum to concentrate the infrared radiation from at least two opposing sides of the peripheral heating body towards the internal opening of the heater.

* * * * *